United States Patent [19]

Staub et al.

[11] 4,367,874

[45] Jan. 11, 1983

[54] TENNIS RACQUET AND METHOD OF MAKING SAME

[75] Inventors: Anthony F. Staub; Norman T. Staub, both of Dayton, Ohio; John R. Erwin, Paradise Valley, Ariz.

[73] Assignee: Starwin Industries, Inc., Dayton, Ohio

[21] Appl. No.: 929

[22] Filed: Jan. 4, 1979

[51] Int. Cl.[3] ..... A63B 49/00

[52] U.S. Cl. ..... 273/73 R

[58] Field of Search ..... 273/73 R, 73 C, 73 H, 273/73 J, 73 D, 73 G

[56] References Cited

U.S. PATENT DOCUMENTS

| | | | |
|---|---|---|---|
| 1,539,019 | 5/1925 | Nikonow | 273/73 C |
| 2,164,631 | 7/1939 | Abell | 273/73 C |
| 3,752,478 | 8/1973 | Flak | 273/73 H |
| 3,801,099 | 4/1974 | Lair | 273/73 C |
| 3,833,219 | 9/1974 | Dean | 273/73 J X |
| 3,999,756 | 12/1976 | Head | 273/73 C |
| 4,165,071 | 8/1979 | Frolow | 273/73 C |
| 4,192,505 | 3/1980 | Tabickman | 273/73 C |
| 4,196,901 | 4/1980 | Durbin | 273/73 G |

FOREIGN PATENT DOCUMENTS

| | | | |
|---|---|---|---|
| 2717 | of 1909 | United Kingdom | 273/73 D |
| 755257 | 4/1956 | United Kingdom | 273/73 C |

OTHER PUBLICATIONS

"Bancroft Catalog"; 1968; p. 3.

*Primary Examiner*—Anton O. Oechsle
*Attorney, Agent, or Firm*—Biebel, French & Nauman

[57] ABSTRACT

A tennis racquet having a polar moment of inertia similar to conventional length racquets, but being longer than conventional racquets with the same or larger size strung surface. Having the same polar moment of inertia as a well playing conventional racquet gives it the same "feel" but with greater reach, and, if desired, a larger strung surface.

3 Claims, 5 Drawing Figures

LENGTH=28-32 INCHES

POLAR MOMENT OF INERTIA= 16,500-20,500 IN.$^2$ -OZ.

TENNIS RACQUET AND METHOD OF MAKING SAME

BACKGROUND OF THE INVENTION

1. Field of the Invention

The present invention relates to tennis racquets, and more particularly, to tennis racquets of greater than conventional length.

2. Prior Art

Many theories of design of tennis racquets have been developed in an attempt to enhance the playing characteristics of a racquet so that it is easier to swing, causes less shock to the arm of the player and provides sufficient strung surface area to present a reasonable size hitting surface for the ball. There is a particularly popular theory at present relating to the positioning of the center of percussion or the so called "sweet spot" of the strung surface area of the racquet, as close as possible to the center of the strung surface are of the racquet to develop certain alleged advantages of the location in this manner such as reduced jar to the players hand and arm. A detailed discussion of such advantages and one manner of relocating the center of precussion closer to the center of the strung area from that of conventional or standard tennis racquets are disclosed in Head U.S. Pat. No. 3,999,756.

However, an analysis of the practical aspects of actual use of a tennis racquet indicates that the positioning of the sweet spot, whether it be approximately $\frac{1}{3}$ the distance from the yoke to the center of the strung surface as is the case in most conventional racquets or whether it is moved to a position half the distance from the yoke to the center of the strung surface area as is the case in the racquet proposed in the above identified patent, is of little consequence from the actual point of view as the racquet is used in play.

In analysis of the position of the center of percussion it is generally assumed that the racquet pivots about a line approximately 3 inches from the butt end of the handle of the racquet which corresponds to the position of the wrist of the player. The analysis can be analogized to a pendulum-like rod pivotally mounted at one end and free to swing about the pivot point so that the center of precussion will be at a distance from the pivot point such that no reaction force will be felt at the pivot point in response to application of a force at the center of precussion.

The fallacy in such analysis is that in practical application, the pivotal connection, i.e. the wrist of the player, and the flexibility or rigidity thereof are totally dependent upon the strength of the grip of the player, which varies greatly. Also, in most playing strokes the wrist is actually held rigid, and the racquet and arm of the player, as well as the torso, are rotated thus actually providing a much larger radius of rotation than would be the case if the racquet were merely swung from the wrist.

Further, in many other shots the racquet, wrist and arm are held rigid along with the torso of the player as the player moves forward into the ball so that motion of the racquet during the period of contact with the ball is substantially translational rather than rotational, which even further distorts the value of determining the center of precussion of the racquet. This is so because in purely translational motion, i.e. pivoting at infinity, the center of percussion is located at the center of gravity which is somewhere on the handle of most racquets, while for rotational motion, the center of percussion for tennis racquets is outward from the center of gravity, usually on the strung surface adjacent the yoke or approaching the center of the strung surface.

Therefore the significance of repositioning the center of percussion from approximately $\frac{1}{3}$ the distance from the yoke to the center of the strung surface of the racquet to a position closer to the center of the strung surface is much reduced under actual playing conditions and does little to enhance the playing characteristics of the racquet.

On the other hand, what is of significance is the polar moment of inertia of the racquet about the axis through which the racquet can reasonably be considered as actually rotating under practical playing conditions. Since most shots of a rotational nature are performed by maintaining a rigid wrist and arm and rotating the torso of the player during the period of contact of the ball, it is presumed that such an axis would be located at approximately the spine of the player, which can be presumed to be approximately two feet from the butt end of the racquet.

The polar moment of inertia is essentially the resistance to acceleration which a racquet exhibits as it is being swung. Many players who have used a plurality of different types of racquets have experienced a significant difference in the way each racquet plays. The majority of this difference, so far as the "feel" of the racquet is concerned, is associated with the polar moment of inertia of the racquet. Some racquets feel "heavy" or sluggish when they are swung. This is due to the greater polar moment of inertia of such racquets compared to other racquets which feel "light" or are more easily swung. Thus, the polar moment of inertia of the tennis racquet is clearly a very important consideration in the value of a tennis racquet, and one which has not heretofore been given sufficient recognition.

As most tennis players know, and as pointed out in Dean U.S. Pat. No. 3,833,219, the conventional, standard tennis racquet has dimensions which in part are derived from the prescribed 36-inch height of the tennis court net at its center. The total longitudinal measurement of a conventional wood racquet is therefore 27 inches while the transverse dimension of the oval racquet head measured at the minor axis thereof is 9 inches, which when added to the longitudinal dimension of the racquet gives the 36-inch dimension.

The corresponding inside dimension or width of the conventional oval racquet head will of course depend upon the thickness of the frame, but according to Mason U.S. Pat. No. 3,515,386, this dimension is approximately $8\frac{1}{4}$ inches for a conventional racquet. Also according to the Mason patent, the maximum longitudinal dimension of the strung surface of a conventional racquet is approximately $10\frac{3}{4}$ inches, to which of course must be added the thickness of the frame portions at opposite ends of the head. Mason also states that the conventional tennis racquet has a handle which is $14\frac{7}{8}$ inches in length, which would mean that the overall length of the head portion of a conventional racquet is $12\frac{1}{8}$ inches to provide the conventional overall length of 27 inches.

The only substantial departure from these general dimensional limitations which has made any significant impact in the tennis playing community is the "Prince" racquet of the above noted Head U.S. Pat. No. 3,999,756. According to that patent, its racquet may have an overall length of between 26 and 28 inches, but the preferred embodiment has the conventional overall length of 27 inches. The head portion, however, is substantially larger than a conventional racquet, the preferred embodiment defining a strung area about 13½ inches long and about 10½ inches wide, or about 60% larger than the average corresponding area of a conventional racquet. Head, however, emphasizes that its racquet is of standard length, weight, and balance.

In approaching the description of the present invention, therefore, it can be assumed that conventional racquets are generally 27 inches in length although the length appears to vary between 26 and 28 inches for some of the more unusual designs. The advantages of a longer racquet are obvious in that it increases the "reach" of a player, thus reducing the amount of movement required by the player across the court in order to hit the ball. One factor which has restricted the length of a racquet is that longer racquets appear to be top heavy, and too much weight is placed in the head since such racquets are generally just a scaled up version of the standard racquet length and size and are thus generally undesirable and have not met with success.

The usefulness of an increased strung surface area over standard or conventional racquets is shown by the success of the racquets made in accordance with the above Head patent. However, the teachings of the prior art are such that no one heretofore has attempted to lengthen the racquet as well as to increase the size of the strung area, because of the awkwardness of the feel of the racquet as it would no doubt be made in accordance with such teachings.

SUMMARY OF THE INVENTION

The present invention overcomes the above described difficulties and disadvantages associated with prior art tennis racquets by taking advantage of the important factor of proper polar moment of inertia while increasing the length and strung surface area of the racquet.

These advantages are accomplished by providing a tennis racquet comprising a frame having a head portion with a strung surface area connected to a handle portion having a butt end, the racquet having an overall length in the range of 28 to 32 inches and further having a polar moment of inertia about an axis perpendicular to a longitudinal central axis of the racquet and about 24 inches from the butt end of the handle, in the range of 16,500 to 20,500 in.$^2$—oz. (0.2224 to 0.2763 ft.-lb.-sec.$^2$). The strung surface of the racquet is substantially eliptical as with most conventional racquets, having the major axis lying along the central longitudinal axis of the racquet and the minor axis perpendicular thereto, and with the strung surface having a length along the major axis in the range of about 11–15 inches and a width along the minor axis in the range of about 9–12 inches, as compared with approximately 10¾ inches and 8¼ inches in conventional racquets. The racquet should weigh in the range of about 10–15 ounces, which is the weight of conventional racquets.

DETAILED DESCRIPTION OF THE PREFERRED EMBODIMENT

Figure 1:
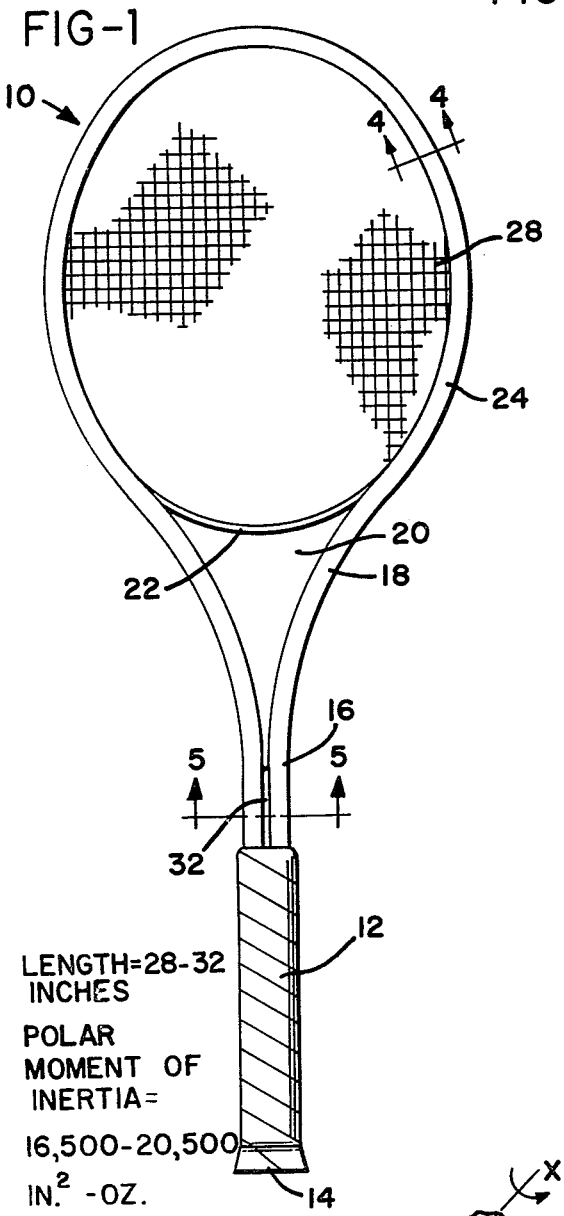
FIG. 1 is an elevational view of the preferred embodiment of the present invention.
Figure 2:
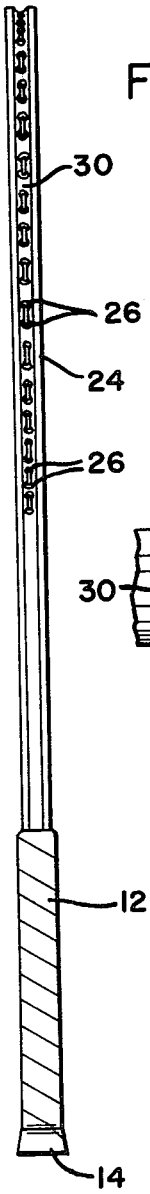
FIG. 2 is a side view of the embodiment of FIG. 1.

The racquet constructed in accordance with the present invention is illustrated in FIGS. 1 and 2 and has the general appearance of a conventional racquet. However, as mentioned above, the racquet is designed to be somewhat longer than conventional racquets, i.e. in the range of 28 to 32 inches in overall length, and in addition, preferably has a somewhat larger head than most conventional racquets.

The racquet 10 is provided with a grip 12 adjacent the butt end 14 thereof and made of the usual material such as leather which is wrapped in a spiral fashion around the lower end of the handle portion of the racquet. The handle portion 16 spreads into the yoke portion 18, which is open in the center 20 and bridged at its upper end portion by an arcuate string securing member 22 secured at its end portions to the head portion 24 of the racquet.

Figure 4:
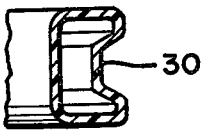
FIG. 4 is a cross sectional view along lines 4—4 of FIG. 1.
Figure 5:
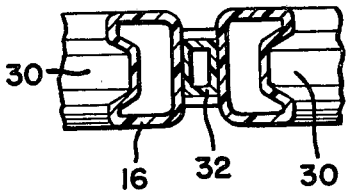
FIG. 5 is a cross sectional view along line 5—5 of FIG. 1.

All of the handle, yoke and head portions are composed of a single frame member of the cross-sections illustrated in FIGS. 4 and 5 and is continuous in construction and extends into the grip 12 of the racquet. The racquet may be made of any suitable material such as metal, plastic or wood, but is preferably constructed of a plastic material with a reinforcing web of material such as graphite fibers and may, for example, be constructed in accordance with the teachings of U.S. Pat. No. 4,045,025.

Referring to FIG. 2, the head portion 24 of the racquet is provided with a plurality of holes 26 extending completely through the frame of the racquet for securing the strings 28 to provide the strung playing surface in the head portion of the racquet. As can be seen for example in FIG. 4, the holes 26 are in the central recessed portion 30 of the head portion 24 with the recessed or grooved portion 30 extending entirely around the frame of the racquet including the handle portion 16. Also as shown in FIG. 5, an additional reinforcing member 32 may be positioned between the adjacent portions of the frame structure in the handle portion and secured thereto such as by epoxy or the like, to maintain the handle portion more rigid than the yoke and head portions of the racquet.

It is to be noted that the details of the construction of the racquet are essentially conventional with the exception of variation in cross section through portions of the racquet to accommodate weight differences as is determined in accordance with the teachings of the present invention. The main distinction in the present invention is in the manner in which the weight is distributed throughout the length of the racquet as is set out in detail below.

The head portion 24 of the racquet is preferably elliptical in configuration, with the major axis extending longitudinally of the racquet coincident with the center line of the racquet extending through the handle portion and grip portion 12. The minor axis of the head is perpendicular to the central axis of the racquet. The width along the minor axis of the strung area of the racquet is preferably in the range of about 9–12 inches, and the length of the strung area in the range of about 11–15 inches with both dimensions being properly sized for a given racquet to maintain a reasonably conventionally appearing elliptical strung area.

As mentioned above, a primary feature of the present invention is the maintaining of a desirable polar moment of inertia on a racquet which is significantly longer than conventional racquets while maintaining approximately the same weight and "feel" as desirable standard racquets. Conventional racquets have a length in the range of 26 to 28 inches, but most are approximately 27 inches long. The weight of conventional racquets varies somewhat with their length as well as being varied to accommodate the desires of individuals for lighter or heavier racquets, but is generally in the range of 10 to 15 ounces.

In addition, a variety of presently available conventional racquets were examined which are considered by a variety of level of skills of players to have good "feel" and playability, to determine their polar moment of inertia. The range of the polar moment of inertia for these racquets was 16,500 to 20,500 in.$^2$-oz., or in other engineering terms, 0.2224 to 0.2763 ft.-lbs.-sec.$^2$. These ranges of weights and polar moments of inertia are therefore considered to be optimum for the preferred embodiment of the present invention, but it is to be understood that both weights and polar moments of inertia outside of this range can be utilized to design a racquet in accordance with the present invention if values above or below these given ranges are considered desirable for certain players.

In any event, it was further determined that a particular conventional racquet (i.e. one made in accordance with the teachings of U.S. Pat. Nos. 4,045,025 and 3,755,037, and manufactured by the assignee thereof) with a weight of 12.75 ounces, 27 inches long and having a polar moment of inertia of 18,300 in.$^2$-oz. (0.24667 ft.-lbs.-sec.$^2$) is an optimum racquet for the purpose of example.

Figure 3:
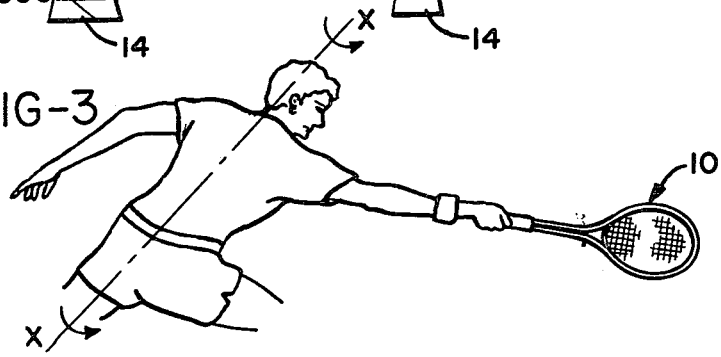
FIG. 3 is a pictorial illustration of a player holding the racquet of the present invention and indicating the axis about which the polar moment of inertia is calculated.

The above values for polar moment of inertia were calculated on the basis of the axis about which they were calculated being situated at 24 inches beyond the butt end 14 of the racquet in a position approximating the player's spine as illustrated by the X—X axis in FIG. 3. For reasons stated above, this position of the axis about which the polar moment of inertia is calculated is considered to be a realistic position, and one which actually provides values which are meaningful in relation to the playability of a racquet as it is actually used in practice.

The polar moment of inertia about a given axis is expressed generally by the equation $$I_R = \int R^2 dm$$

where R is the distance from the unit of mass dm to the axis about which the polar moment of inertia is being calculated. It can be appreciated that the solution of such an equation for a relatively complicated structure such as a tennis racquet could be difficult. It has been discovered, however, that in spite of the obvious differences in shape between a tennis racquet and a uniform rod having the same length and weight, the polar moments of inertia are very similar.

As an example, the value of $I_R$ for the preferred example of a conventional racquet is 18,300 in.$^2$-oz. while $I_R$ for a uniform rod of the same length and weight is 18,700 in.$^2$-oz., which yields a shape factor of approximately 0.9786. The similarity of $I_R$ between rod and racquet greatly simplifies the design of longer, larger tennis racquets because of the simple relation for $I_R$ of a rod:

$$I_R = A/3[(L+24)^3 - (24)^3]$$

where A equals the weight/length of the bar or racquet. Therefore, the proper total weight of a racquet of a different length from that of the preferred example of conventional length can be estimated using the shape factor. The value "24" in the above equation is the distance in inches from the butt end of the racquet or rod to the X—X axis about which the polar moment of inertia is being calculated.

From the last mentioned equation, it is apparent that the weight must vary inversely as the length in accordance with that equation in order for a racquet which is longer and larger to have the same polar moment of inertia as the given conventional example of racquet. Evaluating this equation for the exemplary value of $I_R$ of 18,300 in.$^2$-oz., over the range of racquet lengths from 28 to 32 inches yields the approximate relation $$W = 351/L$$

which expresses the variation of weight with length.

This is a generalization since direct use of this relation yields a racquet approximately a tenth of an ounce too high for a 28-inch racquet and about a tenth of an ounce too low for a 32-inch racquet. However, since it is difficult to manufacture racquets to weights closer than a tenth of an ounce, this relation is adequate for practical purposes. It is to be further noted that as regards the upper and lower ranges of preferable polar moments of inertia expressed above, the relationship which results from this type of analysis, namely $W=384/L$ and $W=324/L$ respectively, are less accurate since the variations from the more nearly exact value are twice as great. However, they are useful guidelines for developing an appropriate racquet design.

As can be seen from the above basic equations for determining polar moment of inertia, the position of the unit mass relative to the axis about which the moment is being calculated substantially affects the total polar moment of inertia calculation. Thus, for a given racquet design, the amount of mass at finite positions along the length of the racquet is important in establishing the proper characteristics.

As an example of utilization of this aspect, a racquet of the preferred example was separated into one inch incremental lengths, and its weight determined as well as the distance from the unit of mass to the axis about which the polar moment of inertia was to be determined, and then the product of the distance squared times the mass unit was calculated for each of the stations as well as the summation of the stations.

Then, as an example of increasing the length of the racquet while maintaining the polar moment of inertia, the length of each element can be extended by a factor (x) 30/27 or 1.111. Thus each element is 1.111 inches in length instead of 1 inch long. The distance of each of these new elements to the rotational axis is then found, and the value of $R^2dm$ for each element of the original racquet is divided by the value of $R^2$ for the new larger racquet to determine the value of dm for each element of the new racquet. By summing all the 27 new values of dm, the weight of the new racquet can be determined. Since each element has the same value of $R^2dm$, and the number of elements is the same, the total rotational moment of the new racquet has the same desirable value as the original exemplary conventional racquet.

Since in the foregoing example, the preselected length of the racquet of the invention is 30 inches, it is apparent that the factor x will change depending on the selected length of the new racquet and the actual length of the conventional reference racquet, although as already noted, conventional racquets are generally about 27 inches in length. In other words, if a conventional racquet noted above as 27 inches in length and 12.75 ounces in weight is used as the reference racquet, then the factor x may vary from 28/27 to 32/27, and the weight will vary correspondingly from a maximum of 351/28 for a racquet of the invention 28 inches in length to a minimum of 351/32 for a racquet of the invention 32 inches in length, all of these values being calculated with respect to a polar moment of inertia of 18,300 in.$^2$-oz.

Thus it can be seen, that by the use of the above technique, a variety of racquets can be designed with polar moments of inertia and weights within the ranges acceptable for well playing conventional racquets and yet the advantages of increased length as well as increased surface area of the strung playing surface can be obtained.

It is preferable that a racquet constructed in accordance with the present invention be made by the techniques disclosed in U.S. Pat. Nos. 4,045,025 and 3,755,037 incorporated herein by reference, which techniques were used to manufacture the above exemplary conventional racquet. The reason for this is that such methods of manufacture promote ease of redistribution of mass along the length of the racquet to obtain the most advantageous location of mass units in order to establish a polar moment of inertia that will produce a well playing racquet.

Although the foregoing illustrates the preferred embodiment of the present invention, variations are possible. All such variations as would be obvious to one skilled in this art are intended to be included within the scope of the invention as defined by the following claims.

What is claimed is:

1. A method of making a tennis racquet, comprising the steps of:

selecting a conventional reference racquet design having a frame including a head portion connected to a handle portion having a butt end, said frame having a predetermined overall length (Lr) in the range of 26–28 inches and a predetermined polar moment of inertia about an axis perpendicular to the longitudinal central axis of said racquet, at about 24 inches from said butt end and remote from said racquet, in the range of 16,500 to 20,500 in.$^2$-oz, selecting a desired length (L) for the new racquet in the range of 28–32 inches and greater than Lr, determining the weight of each of a plurality of incremental elements of said reference racquet along the length of said frame, determining the distance of each such element from said perpendicular axis, multiplying the length of each such element by a factor X equal to L/Lr, determining the new weight of each such element for said new length of racquet by dividing the square of the distance from said perpendicular axis of each original such element times the weight thereof by the square of the distance from said perpendicular axis of each such element of said new length of racquet, determining the necessary cross sectional shapes for portions of the frames of said new length of racquet such that said determined weights of the new such elements and the weight distribution throughout the new length of racquet will be obtained, and then, constructing a new racquet having said selected length and incremental elements of said length and said weights and cross sections as determined in the previous steps, whereby said new racquet will have the same said predetermined polar moment of inertia as said reference racquet.

2. A tennis racquet made according to the method of claim 1.

3. A tennis racquet made according to the method of claim 1 wherein the head portion of said racquet is substantially elliptical with a major axis line along said central longitudinal axis of said racquet and a minor axis perpendicular thereto, and said head portion encloses an area having a length along said major axis in the range of about 11 to 15 inches and a length along said minor axis in the range of about 9 to 12 inches.

* * * * *

UNITED STATES PATENT AND TRADEMARK OFFICE

CERTIFICATE OF CORRECTION

PATENT NO. : 4,367,874

DATED : January 11, 1983

INVENTOR(S) : Anthony F. Staub, Norman T. Staub, John R. Erwin

It is certified that error appears in the above—identified patent and that said Letters Patent is hereby corrected as shown below:

Column 1, line 20, "are" should be --area--.

Signed and Sealed this

*Fifth* Day of *April 1983*

[SEAL]

*Attest:*

GERALD J. MOSSINGHOFF

*Attesting Officer*

*Commissioner of Patents and Trademarks*